United States Patent [19]

Thompson, deceased et al.

[11] 4,050,197

[45] Sept. 27, 1977

[54] BLADE AND SCISSORS SHARPENER

[76] Inventors: Willis F. Thompson, deceased, late of Portland, Maine; by Nelson L. Thompson, administrator, 8347 Wagon Wheel Road, Alexandria, Va. 22309

[21] Appl. No.: 604,788

[22] Filed: Aug. 14, 1975

Related U.S. Application Data

[63] Continuation of Ser. No. 437,319, Jan. 28, 1974, abandoned.

[51] Int. Cl.[2] ..... B24B 3/52; B24B 3/54

[52] U.S. Cl. ..... 51/208; 51/210

[58] Field of Search ..... 51/102, 128, 168, 173, 51/205 F, 205 WG, 208, 210, 248; 76/82.2, 89, 89.1

[56] References Cited

U.S. PATENT DOCUMENTS

| | | | |
|---|---|---|---|
| 2,186,715 | 1/1940 | Zimmer | 76/89 |
| 2,496,139 | 1/1950 | Vars | 51/210 |
| 2,778,249 | 1/1957 | Roberts | 76/89 |
| 3,032,938 | 5/1962 | Voll | 51/210 |
| 3,648,414 | 3/1972 | Thompson | 51/208 |
| 3,808,746 | 5/1974 | Knecht | 51/128 |

FOREIGN PATENT DOCUMENTS

| | | | |
|---|---|---|---|
| 99,972 | 7/1968 | Japan | 51/210 |
| 93,036 | 12/1958 | Norway | 51/128 |
| 1,233,340 | 5/1971 | United Kingdom | 51/128 |

*Primary Examiner*—Al Lawrence Smith
*Assistant Examiner*—Nicholas P. Godici

[57] ABSTRACT

A blade sharpener is disclosed that has a sharpening unit rotatably mounted in a support with an upper portion thereof exposed to enable a knife blade to be reciprocated with a beveled edge maintained in contact with a side of the abrasive wheel of the unit by the engagement of the opposite side of the blade with a blade support, which is part of the unit, the unit turning during such reciprocation. The connection between the unit and the support permits the unit to wobble as it rotates as required by the reciprocated blade. The sharpener also includes a guide rotatable between a position under the unit to a position in which it overlies it and is provided with a slot enabling a scissors blade to be inserted therein with its beveled edge in tangential engagement with the periphery of the abrasive wheel. The guard includes a portion that may be depressed into engagement with the unit to hold it against turning as the scissors blade is reciprocated.

9 Claims, 7 Drawing Figures

BLADE AND SCISSORS SHARPENER

This is a continuation of application Ser. No. 437,319, filed Jan. 28, 1974, now abandoned.

BACKGROUND OF THE INVENTION

Of the many different knife sharpeners made available for household use, those made in accordance with U.S. Pat. No. 2,469,797 have had wide acceptance. That type of sharpener consists of an abrasive wheel and blade supporting means combined therewith to provide a unit, the blade supporting means having a surface against which one side of a blade is held at an angle such that the beveled edge of its other side then properly engages a side of the abrasive wheel with the unit rolling forwardly and rearwardly on a supporting surface as the knife is reciprocated.

Several advantages occur if such a sharpening unit is held captive by rotatably mounting it in a support with one such advantage being that sharpener may be provided with a removable guide enabling a scissors blade to be brought into and reciprocated in tangential engagement with the periphery of the abrasive wheel and thus sharpened with the unit held against rotating. See U.S. Pat. No. 3,648,414.

THE PRESENT INVENTION

The present invention has for one of its principal objectives, the provision of a knife sharpener in which a sharpening unit of the above referred-to type is held captive in a support by a connection that not only permits the unit to rotate but also allows it to wobble in order that it may better accommodate the curves of cutting edges of knife blades as the knife is reciprocated.

Another objective of the invention is to provide that such a connection consists of a hollow hub that is part of the unit and a rigid axle held by the support, extends therethrough, the hub and axle being dimensioned so that the axle is a loose fit therein.

Another objective of the invention is to provide a sharpener in which the sharpening unit is also of the same type and is held captive in a support by a connection that permits the unit to rotate but not necessarily to wobble and is provided with a guide manually movable into and out of an operative position overlying and holding the unit against rotation and having a portion engageable in said operative position by one side of a scissors blade when in tangential engagement with the periphery of the abrasive wheel of the unit, its beveled edge then being substantially flat against the surface thereof while the blade is manually reciprocated.

Yet another objective of the invention is to provide that the shield is arcuate and is connected to the support coaxially with the unit but is radially spaced therefrom in order to be independently rotatable between overlying and underlying positions relative thereto, the guide, in its underlying position being out of the path of a reciprocated knife blade but having a portion exposed to be digitally engaged in rotating the guide into its overlying operative position or to again return it to its inoperative position.

BRIEF DESCRIPTION OF THE DRAWINGS

The accompanying drawings illustrate a preferred embodiment of the invention of which

THE PREFERRED EMBODIMENT OF THE INVENTION

Figure 1:
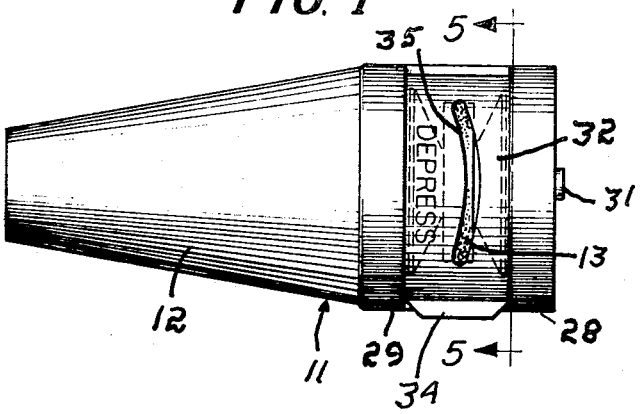
FIG. 1 is a top elevational view of the sharpener with the scissors guide in its operative position.
Figure 2:
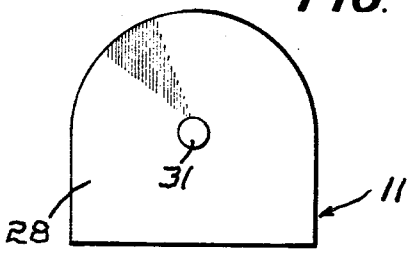
FIG. 2 is a front end view of the sharpener.
Figure 3:
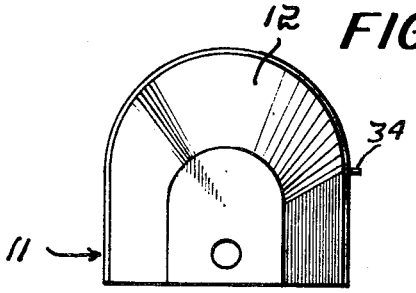
FIG. 3 is a view of the sharpener as seen from its handle end.
Figure 4:
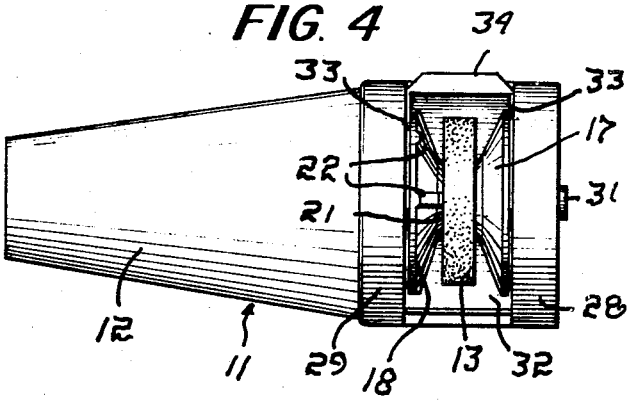
FIG. 4 is a view similar to FIG. 1 but with the scissors guide rotated into its underlying, inoperative position.
Figure 5:
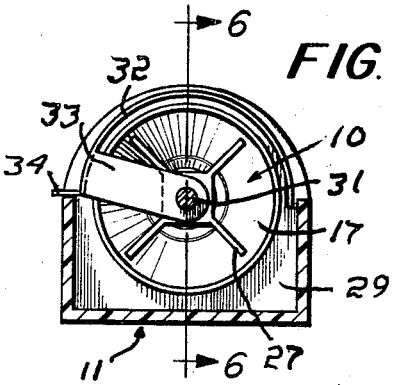
FIG. 5 is a section taken approximately along the indicated line 5—5 of FIG. 1.
Figure 6:
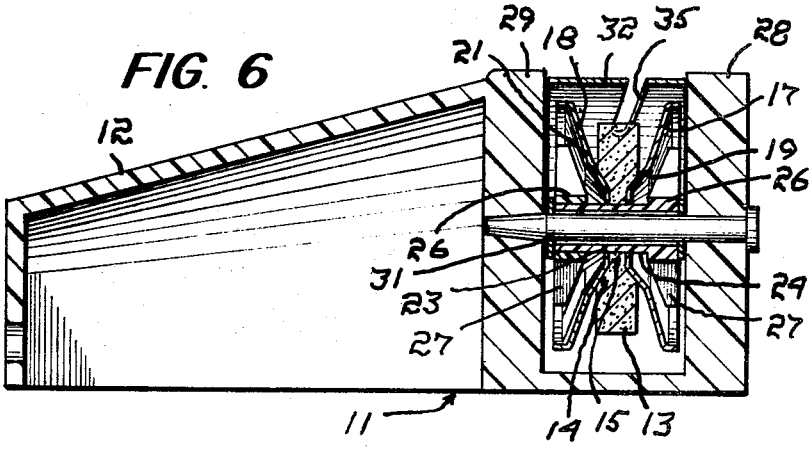
FIG. 6 is a section, on an increase in scale, taken approximately along the indicated line 6—6 of FIG. 5.
Figure 7:
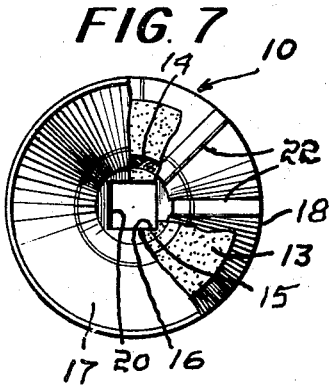
FIG. 7 is a view of the sharpening unit with both the front blade holder and the grinding wheel partly broken away.

The preferred embodiment of the invention utilizes a blade sharpening unit generally indicated at 10, generally of the type shown in said patents and rotatably supported by a flat-bottomed holder, generally indicated at 11, which includes a hollow, tapered handle 12, the undersurface of which is open.

In more detail, the sharpening unit 10 consists of an abrasive wheel or disc 13, the periphery of which is flat, transversely considered. The sides of the wheel 13 have axial, inwardly tapering recesses 14 establishing a central web 15 having an axially located, square hole 16. Blade supports 17 and 18 are located on opposite sides of the wheel 13 and these have surfaces disposed to provide support for one side of a knife blade maintaining the beveled edge of its other side at the desired sharpening angle, usually 22.5° – 30°, relative to the proximate side of the wheel 13. The member 17 has a frusto-conic surface 19, providing such support and disposed towards one side of the wheel 13 with its extremity entrant of the recess 14 of that side and having a square, axially located hole 20. The blade support 18 is generally similar to the blade support 17 but has its frusto-conic surface 21 provided with radially disposed, equally spaced ribs 22 extending into the proximate wheel recess 14 and with its recess-entering end having a square hole 23 In the case of the blade support 18, the ribs 22 not only hold the blade at the correct sharpening angle relative to the grinding wheel but also cause the beveled edge being sharpened to move vertically as the unit 10 rotates. See U.S. Pat. No. 3,238,673.

a square hub 24 having an axial bore 25 fits the square holes 20, 23, and 16 ensuring that the wheel 13 and the blade holders 17 and 18 will rotate together. The holders 17 and 18 are shells and the hub 24 is of sufficient length so that its ends are exposed within them. End caps 26 are cemented or otherwise secured to the ends of the hub 24 to hold the blade supports against the wheel 13 and the end caps 26 are shown as having radial braces 27 backing the concave faces of the blade supports 17 and 18. The members 17 and 18 may both be indentical and of either type.

The holder 11 has spaced front and rear walls 28 and 29, respectively, with their lower portions interconnected by side walls 30 to provide a cavity dimensioned freely to accommodate the lower half of the blade sharpening unit 10 when mounted on an axle 31 supported by the walls 28 and 29 and to serve as a well if wet-grinding is desired. The axle 31 extends freely through the bore 25 of the hub 24 thus enabling the unit 10 to wobble as it turns on its axle thereby accommodating itself to variably shaped knife edges, their curved ends, for example.

An arcuate guide for use in sharpening scissors blades is indicated at 32 and is of sufficient width to overlie the sharpening unit 10. The blade guide 32 has radial arms 33 at its margins whose free ends are apertured to freely receive the axle 31 and the arms 33 are of sufficient length that the guide is clear of the periphery of the sharpening unit 10 when thus connected thereto. The guide 32 is, however, adapted to be brought into engagement with the unit 10 to prevent its rotation, a function attained by forming it from resiliently flexible material to enable such engagement to be easily effected by digitally applied pressure.

The arcuate extent of the guide 32 is such that it may have a first position is the holder 11 in which it overlies the exposed portion of the unit 10 with one end extending below one side wall 30 and the other end having an outwardly disposed, digitally engageable tab 34 resting on the other side wall 30. As the cavity of the holder 11 is dimensioned to freely receive the guide 32 and as the guide 32 is rotatably supported, it may be readily turned into a second or concealed position in which the unit 10 is uncovered with the first named end of the guard 32 close to the upper edge of the last named side wall 30 and the tab 34 now resting on the first named side wall.

The guide 32 has a lengthwise slot 35 that is arcuate transversely considered, and whose end portions overlie the periphery of the grinding wheel 13. The slot length is such that a scissors blade may be inserted therein for tangential engagement with the flat surface of the grinding wheel 13 without engaging its ends with the transverse curvature such that a thus disposed scissors blade is held at a desired edge sharpening angle relative to the periphery of the grinding wheel 11, say an angle of about 85°.

From the foregoing, it will be appreciated that blade sharpeners in accordance with the invention are well adapted to meet a wide range of requirements With the guide 32 turned into its concealed, inoperative position, a knife blade can be quickly sharpened with the easiest procedure being to place the holder 11 on a shelf or table and, while it is held with one hand, reciprocate a knife held in the other hand with one beveled edge of its blade in contact with one side of the abrasive wheel 13 and the opposite blade side maintained against the proximate blade support of the unit 10, the contact of the beveled blade edge being against the face of that side of the abrasive wheel or against that face in a zone adjacent or at the junction with the periphery of the abrasive wheel 13. The fact that the sharpening unit is free-floating ensures effective sharpening even where the blade curves or the blade edge is scalloped. The knife blade is then shifted to bring the other beveled edge of its blade against the other side of the abrasive wheel 13 and reciprocate it with the side of the blade against the other blade support. This procedure is usually easier than the reversal of the knife relative to the abrasive wheel in order to enable both beveled edges against the same side of the abrasive wheel 13.

When scissors blades are to be sharpened, the guide 32 is digitally rotated from its concealed, inoperative position into its operative position in which it covers the sharpening unit 10. First one scissors blade and then the other is inserted in the guard slot 34 to bring its beveled edge into tangential contact with the periphery of the abrasive wheel 13. The guide 32 is then depressed, desirably where marked, to bring that portion of it into engagement with the subjacent blade holder thereby to hold the unit 10 against turning while the scissors blade is reciprocated.

I claim:

1. A blade sharpener comprising a holder including a pair of end wall members, a unit dimensioned to be a free but close fit between said walls and including an abrasive wheel the periphery of which is flat transversely considered, and a pair of blade supporting members, one at each side of said wheel and engageable by the side of a blade and downwardly inclined towards the wheel to enable one side of a blade to be seated thereon with the beveled edge of the other side of the thus held blade to be held in contact with the proximate side of the wheel, and axial supporting means between said end wall members and means for mounting said unit on said axial supporting means with a loose fit with respect thereto whereby said unit rotates as the thus held blade is reciprocted and is also free to wobble to a limited extent said blade supports of a diameter greater than that of the wheel and close to but below the upper edge of said wall members with the upper edges of said wall members each substantially in the plane inclusive of the thus positioned blade.

2. The blade sharpener of claim 1 and a guide connected to said holder for manual movement between first and second positions relative to said unit, in said first position, said guide in said first position exposing said unit to enable a knife blade to be sharpened and in said second position overlying said unit, said guide including a portion engageable in said second position by one side of a scissors blade when its beveled edge is placed in tangential engagement with the periphery of said wheel with said beveled edge laying substantially flat against the surface thereof, and said guide, when in said second position manually movable into engagement with said unit to hold it against rotation while the blade is manually reciprocated.

3. The sharpener of claim 2 in which the guide is arcuate and is rotatably connected to the support coaxially with said unit but radially spaced therefrom, said guide extending over the periphery of the unit and rotatable between a position overlying said unit and an underlying position.

4. The sharpener of claim 3 in which the guide is approximately 180° in extent.

5. The sharpener of claim 3 in which the holder includes portions including end and side walls exposing the upper portion of the unit and concealing the lower portion thereof and the guide includes a tab engageable with one side wall in its overlying position and the other side wall in its underlying position.

6. The sharpener of claim 5 in which the guide is approximately 180° in extent.

7. The sharpener of claim 3 in which said guide is of resiliently yieldable stock digitally depressable against the unit when the guide is in its overlying position.

8. The sharpener of claim 5 in which the end walls extend above the periphery of the unit to define with the side walls a slot, the guide is of the same width as the slot and has a slot defining said position.

9. The sharpener of claim 8 in which the holder has a well dimensioned to accommodate the lower portion of the unit.

* * * * *